US010070768B2

(12) United States Patent
Young

(10) Patent No.: US 10,070,768 B2
(45) Date of Patent: Sep. 11, 2018

(54) CLEANING APPARATUS, A METHOD OF CLEANING, AND A RETROFITTING METHOD

(71) Applicant: Ronald Alexander (Scot) Young, West Midlands (GB)

(72) Inventor: Ronald Alexander (Scot) Young, West Midlands (GB)

(73) Assignee: Scot Young Research Limited, Lye Bypass, Lye Stourbridge, West Midlands (GB)

( * ) Notice: Subject to any disclaimer, the term of this patent is extended or adjusted under 35 U.S.C. 154(b) by 861 days.

(21) Appl. No.: 14/385,186

(22) PCT Filed: Mar. 14, 2013

(86) PCT No.: PCT/GB2013/050639

§ 371 (c)(1),
(2) Date: Sep. 15, 2014

(87) PCT Pub. No.: WO2013/136079

PCT Pub. Date: Sep. 19, 2013

(65) Prior Publication Data

US 2015/0040942 A1 Feb. 12, 2015

(30) Foreign Application Priority Data

Mar. 16, 2012 (GB) ..... 1204694.2

(51) Int. Cl.
*A47L 13/60* (2006.01)
*A47L 13/258* (2006.01)
(Continued)

(52) U.S. Cl.
CPC ..... *A47L 13/60* (2013.01); *A47L 13/24* (2013.01); *A47L 13/258* (2013.01); *A47L 13/58* (2013.01); *B08B 1/002* (2013.01)

(58) Field of Classification Search
CPC ..... A47L 13/258; A47L 13/60; A47L 13/58; A47L 13/59
(Continued)

(56) References Cited

U.S. PATENT DOCUMENTS 2,147,782 A 12/1935 Abbott
2,796,617 A * 6/1957 Bradshaw ..... A47L 13/60 100/211
(Continued)

FOREIGN PATENT DOCUMENTS

DE 2227554 * 12/1973 ..... A47L 13/50
FR 2187266 A 1/1974
(Continued)

OTHER PUBLICATIONS

English translation of DE 2227554, Huebner, published Dec. 1973.*
(Continued)

*Primary Examiner* — Laura C Guidotti
(74) *Attorney, Agent, or Firm* — Thedford I. Hitaffer; Hitaffer & Hitaffer, PLLC

(57) ABSTRACT

A cleaning apparatus including a mop and a cleaning device, wherein: the mop includes: a mop material carrying member for holding mop material; and a mop abutment member, the cleaning device is for cleaning mop material which freely depends from the mop material carrying member of the mop, the cleaning device includes: one or more cleaning arrangements for cleaning mop material; and a pair of abutment members located with respect to the one or more cleaning arrangements and at least partially defining an access aperture through which access to the one or more cleaning arrangements is provided, and the mop abutment member and the pair of abutment members of the cleaning device are configured for abutment in use to limit movement of the mop
(Continued)

material carrying member through the access aperture towards the one or more cleaning arrangements.

20 Claims, 8 Drawing Sheets

(51) Int. Cl.
*A47L 13/58* (2006.01)
*A47L 13/24* (2006.01)
*B08B 1/00* (2006.01)

(58) Field of Classification Search
USPC ..... 15/262, 260
See application file for complete search history.

(56) References Cited

U.S. PATENT DOCUMENTS 3,987,513 A * 10/1976 Gonzales ..... A47L 13/60 15/262
4,881,290 A * 11/1989 Bohacek ..... A47L 13/253 15/147.2
7,243,392 B2 7/2007 Demirtas
8,099,824 B2 * 1/2012 Dingert ..... A47L 13/258 15/228
2006/0196001 A1 * 9/2006 Demirtas ..... A47L 13/58 15/260

FOREIGN PATENT DOCUMENTS

GB 2 480 294 A 11/2011
GB 2480294 A 11/2011
JP 2000-245676 12/2000
WO 2005/027702 A1 3/2005
WO 2005027707 A1 3/2005
WO 2011148155 A2 12/2011

OTHER PUBLICATIONS

UKIPO Search Report dated Jul. 20, 2012 for UK Application No. GB1204694.2 filed Mar. 16, 2012, UK Intellectual Property Office, Newport South Whales, UK.
UKIPO Examination Report dated Nov. 7, 2014 for UK Application No. GB1204694.2 filed Mar. 16, 2012, UK Intellectual Property Office, Newport South Whales, UK.
UKIPO Examination Report dated Mar. 11, 2015 for UK Application No. GB1204694.2 filed Mar. 16, 2012, UK Intellectual Property Office, Newport South Whales, UK.
International Search Report dated Jun. 18, 2013, in Int'l Appl. No. PCT/GB2013/050639 filed Mar. 14, 2013, WIPO, Geneva, Switzerland.
International Preliminary Report on Patentability dated Sep. 16, 2014, in Int'l Appl. No. PCT/GB2013/050639 filed Mar. 14, 2013, WIPO,Geneva, Switzerland.
Written Opinion of the International Searching Authority dated Jun. 18, 2013, in Int'l Appl. No. PCT/GB2013/050639, filed Mar. 14, 2013, WIPO,Geneva, Switzerland.
Australian Examination Report dated Sep. 17, 2014 for AU Application No. 2013234084 filed Mar. 14, 2013, IP Australia, Woden ACT.
EPO, English Machine Translation of FR 2187266 filed Jan. 18, 1974, date Apr. 30, 2015, EPO, Munchen, Germany.
International Search Report, WIPO, Int'l Appl. No. PCT/GB2013/050639, dated Mar. 14, 2013.
Englishing language Abstract of Japanese Publication No. JP 2000-245676, published Dec. 9, 2000, to Hitachi Ltd, for a Mop Cleaner, from the Japan Platform for Patent Information, dated Apr. 17, 2018 (www.j-platpat.inpit,go.jp).

* cited by examiner

CLEANING APPARATUS, A METHOD OF CLEANING, AND A RETROFITTING METHOD

CROSS-REFERENCE TO RELATED APPLICATIONS

This application, filed under 35 USC 371, is a United States National Stage Application of International Application No. PCT/GB2013/050639, filed Mar. 14, 2013, which claims priority to GB Application No. 1204694.2, filed on Mar. 16, 2012, the disclosures of which are incorporated herein by reference.

This invention relates to a cleaning apparatus for cleaning mop material, to a method of cleaning mop material, and to a method of retrofitting an abutment member to a mop.

The use of microfibre material cloths and the like for cleaning and drying has brought considerable advantages in the cleaning industry. Such materials readily take up dirt particles and retain them. This has resulted in a reduced number of dirt particles and bacteria remaining on a surface, such as a floor, which is cleaned using such a cloth. Particularly in hospital environments the use of microfibre mop material has proved very useful in the fight against patient infection.

Microfibre materials require frequent laundering in a washing machine in order to ensure that bacteria present in dirt particles are not spread by a heavily soiled microfibre material mop for example, on a floor.

WO2011148155 discloses a particularly innovative cleaning device for cleaning mop material such as microfiber mop material. The cleaning device includes a pair of bristle carrying parts each carrying a plurality of bristles, each of the bristle carrying parts being rotatable about a respective axis of rotation by at least one motive device, the bristle carrying parts being rotatable in opposite senses of direction such as to draw hanging mop material introduced into the opening between the bristle carrying parts, whereby bristles carried by the bristle carrying parts engage the mop material.

It is has been discovered that there is a need to make the device disclosed in WO2011148155 easier to use.

Accordingly, embodiments of the present invention seek to ameliorate one or more problems associated with the prior art.

Accordingly, an aspect of the present invention provides a cleaning apparatus including a mop and a cleaning device, wherein: the mop includes: a mop material carrying member for holding mop material; and a mop abutment member, the cleaning device is for cleaning mop material which freely depends from the mop material carrying member of the mop, the cleaning device includes: one or more cleaning arrangements for cleaning mop material; and a pair of abutment members located with respect to the one or more cleaning arrangements and at least partially defining an access aperture through which access to the one or more cleaning arrangements is provided, and the mop abutment member and the pair of abutment members of the cleaning device are configured for abutment in use to limit movement of the mop material carrying member through the access aperture towards the one or more cleaning arrangements.

The one or more cleaning arrangements may include one or more brushes.

The one or more cleaning arrangements may be drivable by a motive device.

The one or more cleaning arrangements may include one or more rotatable rollers.

The or each rotatable roller may be configured to be rotated so as to draw the freely depending mop material through the access aperture.

The cleaning device further may include a wringer mechanism.

The wringer mechanism may be configured for operation independently of the one or more cleaning arrangements.

The mop material carrying member may include a central hub and at least one wing member.

The mop material carrying member may include a bracket arrangement configured for removably holding mop material.

The bracket arrangement may include a bar.

The mop abutment member may be secured to the bracket arrangement.

The mop may include a plurality of mop abutment members.

The mop may further include the mop material.

The mop abutment member and at least one of the pair of abutment members may be configured for abutment in use to limit movement of the mop material carrying member with respect to the one or more cleaning arrangements such that substantially all of the mop material is contactable with at least one of the one or more cleaning arrangements during use.

The mop abutment member and at least one of the pair of abutment members may be configured for abutment in use to limit movement of the mop material carrying member with respect to the one or more cleaning arrangements such that the mop material carrying member is substantially prevented from contacting the or each cleaning arrangement during use.

Another aspect of the present invention provides a method of using a cleaning apparatus, the method including: moving the mop material carrying member towards the or each cleaning arrangement of the cleaning device until the mop abutment member abuts the abutment member of the cleaning device.

The method may further include: subsequently moving the mop material carrying member away from the or each cleaning arrangement of the cleaning device.

Another aspect of the present invention provides a method of retrofitting a mop abutment member to a mop to form a mop for use in a method as above, the method of retrofitting including: providing a mop having a mop material carrying member for holding mop material; and securing a mop abutment member to the mop material carrying member.

Embodiments of the invention are described with reference to the accompanying drawings in which.

Figure 1:
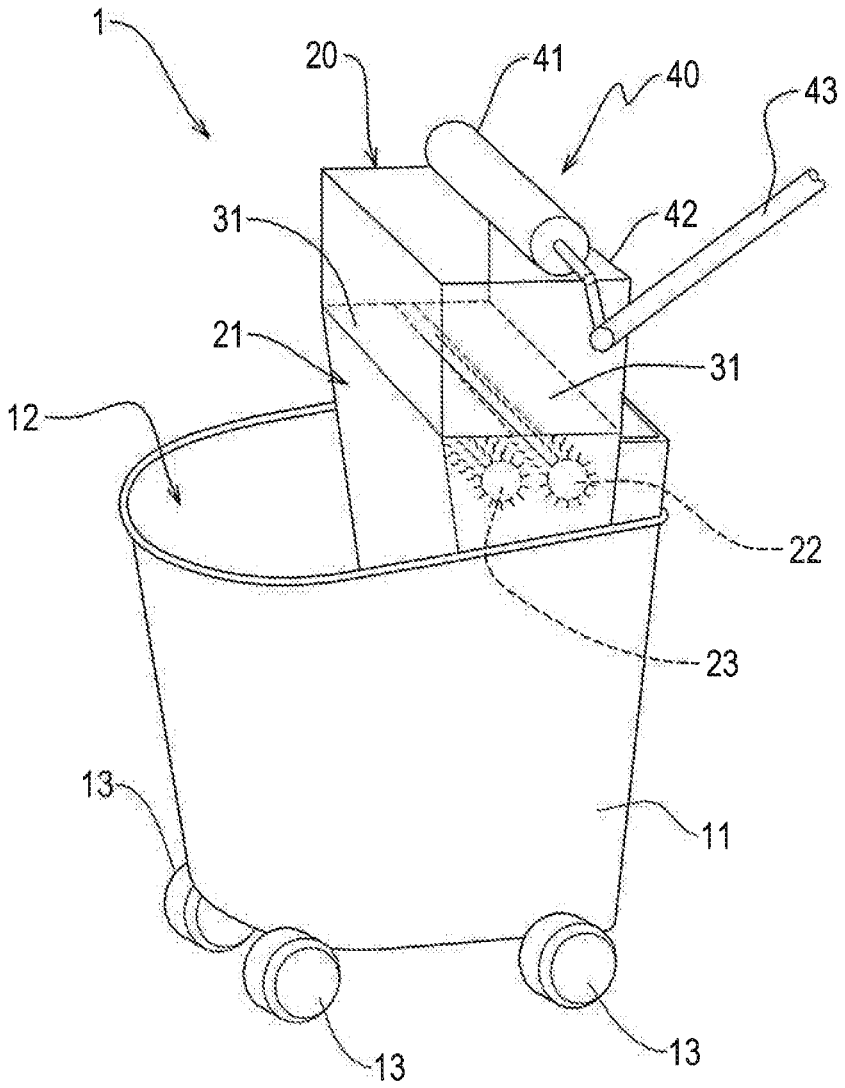
FIG. 1 shows a cleaning apparatus for use in embodiments.
Figure 2:
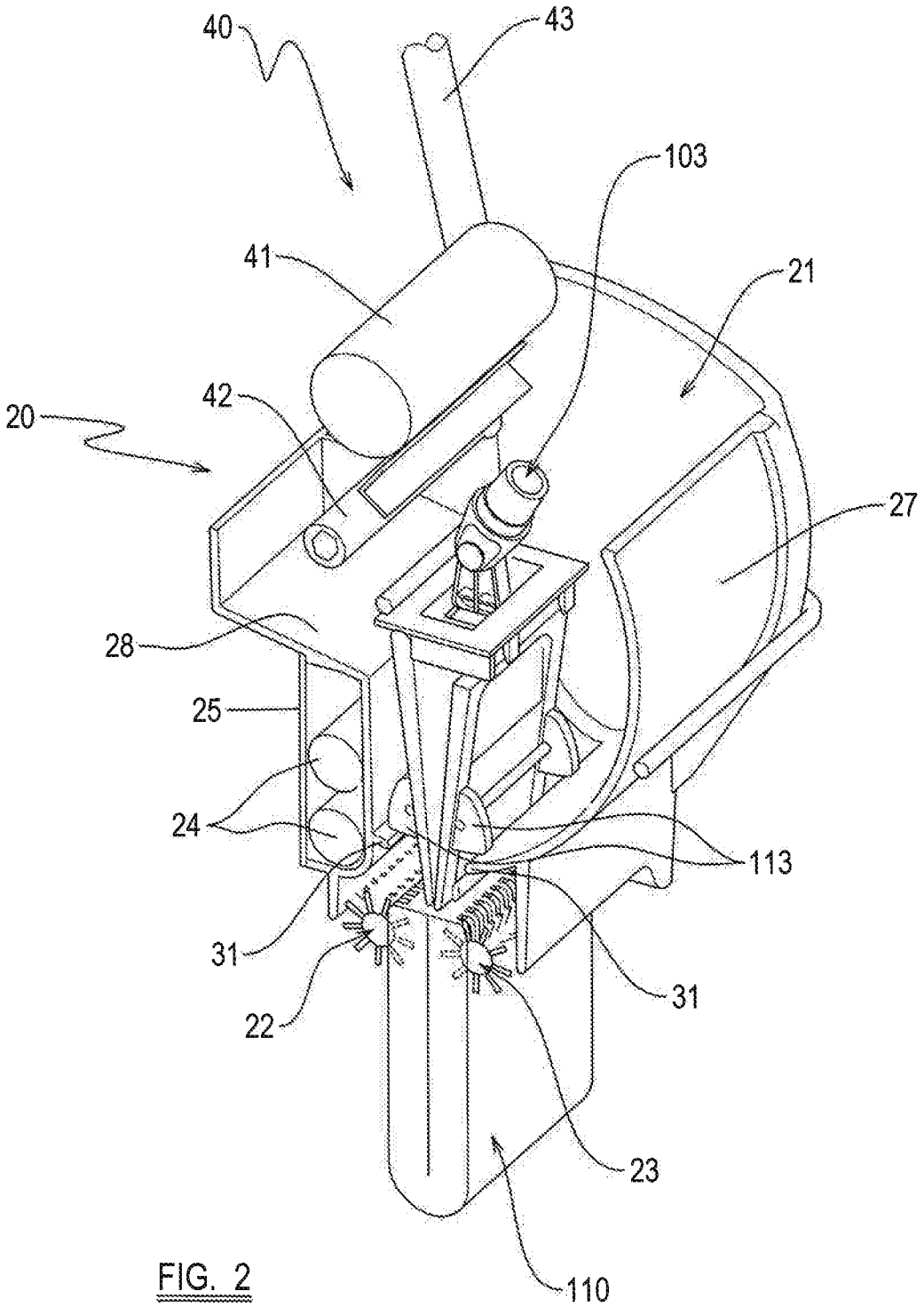
FIG. 2 shows (with a partial cross-sectional view) a cleaning apparatus and mop in accordance with embodiments.

Referring first to FIGS. 1 and 2, a cleaning apparatus 1 is shown which includes a receptacle in the form of a bucket 11 with an internal volume configured to receive and retain cleaning/rinsing liquid (not shown).

The bucket 11 has an open upper end 12. The bucket 11 may include a plurality of wheels 13—which may be coupled directly to the bucket 11 or which may be part of a dolly (not shown) which is configured to carry the bucket 11.

The cleaning apparatus 1 further includes a cleaning device 20 which is mountable to the bucket 11. This mounting may be a removable mounting such that the cleaning device 20 can be disengaged from the bucket 11 without damaging the bucket 11 or cleaning device 20. This mounting may be achieved by the use of cooperative mounting members of the bucket 11 and the cleaning device 20. The cooperative mounting members may include, for example, a hook on one of the bucket 11 and cleaning device 20, the hook being configured to engage a lip on the other of the bucket 11 and cleaning device 20. The hook may be part of a clip configured for movement with respect to the rest of the bucket 11 or cleaning device 20. A plurality of hooks may be provided. The cleaning device 20 and bucket 11 are preferably configured such that the cleaning device 20 extends at least partially into the internal volume of the bucket 11 when the cleaning device 20 is mounted to the bucket 11. One or more ledges, ridges, shelves, or the like, may be provided to help to support the cleaning device 20 with respect to the bucket 11.

The cleaning device 20 has a main body 21 which houses one or more cleaning arrangements such as brushes 22,23. The or each cleaning arrangement 22,23 may be mounted for movement with respect to the main body 21 of the cleaning device 20. This movement may be rotational or linear movement. In the depicted embodiment, the or each cleaning arrangement 22,23 is generally cylindrical in form and is mounted for rotational movement with respect to the main body 21 of the cleaning device 20.

In the depicted embodiment, two cleaning arrangements 22,23 are provided. A gap is defined between the two cleaning arrangements 22,23—the cleaning arrangements 22,23 generally having parallel central longitudinal axes and the cleaning arrangements 22,23 being configured for rotation about their respective central longitudinal axes.

In other embodiments, it will be appreciated that three or more cleaning arrangements 22,23 may be provided.

Figure 3:
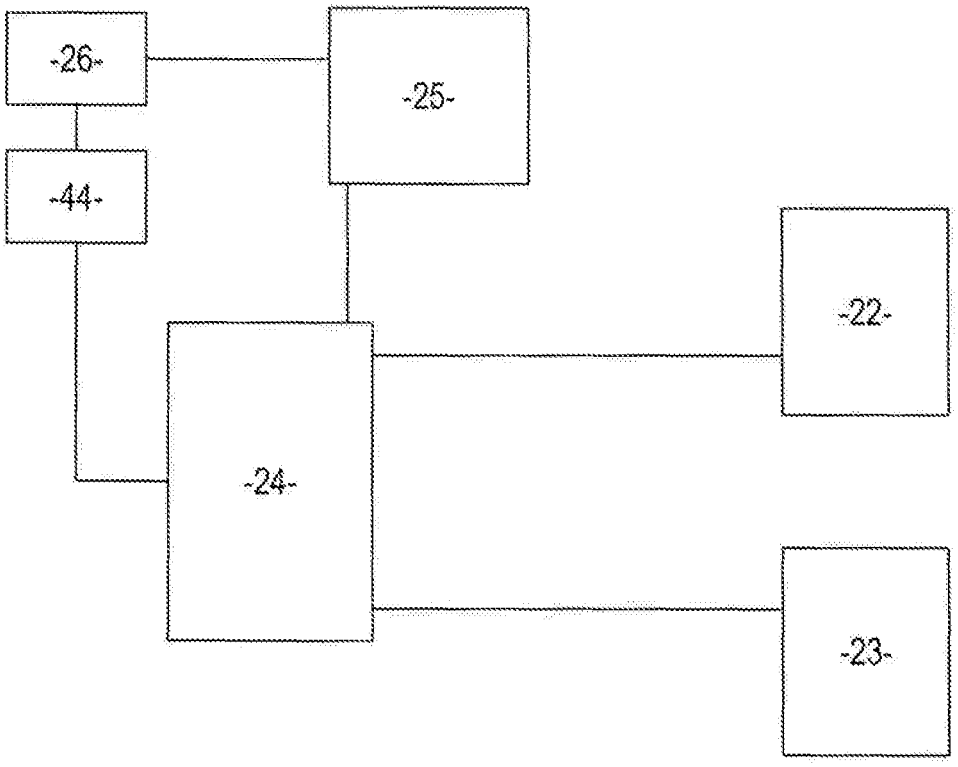
FIG. 3 shows a schematic view of aspects of embodiments.

Movement of the or each cleaning arrangement 22,23 may be driven by, for example, a driving arrangement 24 (see FIG. 3) which may include one or more motors. A transmission (not shown) may be provided between the driving arrangement 24 and the one or more cleaning arrangements 22,23. The driving arrangement 24 may be housed in the main body 21 of the cleaning device 20 and may be in a sealed or substantially sealed compartment.

The driving arrangement 24 may be electrically connected to a power source 25. In embodiments, the power source 25 includes one or more battery cells which may be rechargeable battery cells. The power source 25 may be housed in the main body 21 of the cleaning device 20 and may be in a sealed or substantially sealed compartment. The power source 25 may include a connector to allow the power source 25 to be coupled to an external power supply—for example, to recharge one or more rechargeable battery cells of the power source 25.

The driving arrangement 24 is coupled to a switch 26 which is in electrical connection between the power source 25 and the driving arrangement 24. Actuation of the switch 26 is configured to commence operation of the driving arrangement 24 to drive movement of the or each cleaning arrangement 22,23 with respect to the main body 21 of the cleaning device 20. The switch 26 may be further configured such that further actuation of the switch 26 is configured to cease operation of the driving arrangement 24 to cease movement of the or each cleaning arrangement 22,23 with respect to the main body 21 of the cleaning device 20.

In an embodiment, the cleaning device 20 further includes a wringer mechanism 40. The wringer mechanism 40 is configured to wring mop material. The wringer mechanism 40 may be located such that it is generally above the one or more cleaning arrangements 22,23 in a normal orientation.

The wringer mechanism 40 may include one or more rollers 41. The wringer mechanism 40 may include a shoe 42 and a roller 41—the shoe 42 and roller 41 being configured such that mop material may be received between the shoe 42 and roller 41. The roller 41 and shoe 42 may be moveable with respect to each other such that a compressive force may be applied to mop material between the roller 41 and the shoe 42. In operation, a user may draw mop material between the roller 41 and shoe 42 to wring the mop material. In embodiment, the wringer mechanism 40 includes two or more pressing members (not shown), the pressing members being moveable with respect to each other and being configured to compress mop material received therebetween. In an embodiment, a pair of hinged pressing members (not shown) is configured to compress mop material against a third pressing member (not shown) in the form of a shelf or grid. Operation of wringer mechanism 40 may be actuated by a lever 43.

In embodiments, operation of the wringer mechanism 40 ceases operation of the driving arrangement 24. A switch 44, which may be a micro-switch, may be provided in electrical communication with the driving arrangement 24 and the power source 25. The switch 44 may be configured to actuate on operation of the wringer mechanism 40 so as to cease operation of the driving arrangement 24.

The main body 21 of the cleaning device 20 defines a volume. In embodiments, this volume is generally above the or each cleaning arrangement 22,23 in a normal orientation. The main body 21 of the cleaning device 20 includes a first wall 27 which, in embodiments, presents a concave surface to the volume. The first wall 27 has a first end and a second end. In an embodiment and in a normal orientation, the first end is an upper end of the first wall 27 and the second end is a lower end of the first wall 27. Opposing the first wall 27 across a width of the volume is a second wall 28. The second wall 28 includes a first portion which extends from a second end of the second wall 28. In an embodiment, and in a normal orientation, the second end of the second wall 28 is a lower end of the second wall and the first portion extends upwardly. A second portion of the second wall 28 extends from the first portion and forms an inclined platform which extends away from the first wall 27. The second wall 28 includes a third portion which extends in a direction substantially parallel to the first portion of the second wall 28. In an embodiment, and in a normal orientation, the third portion extends generally upwardly. First and second side walls extend between the first 27 and second 28 walls to define the volume.

In an embodiment, the wringer mechanism 40, if provided, is located adjacent the second portion of the second wall 28. In an embodiment, and in a normal orientation, the wringer mechanism 40, if provided, is positioned generally above the second portion of the second wall 28.

A pair of abutment members 31 (see FIGS. 1 and 2) is positioned adjacent the one or more cleaning arrangements 22,23 between the volume defined by the main body 21 and the one or more cleaning arrangements 22,23. A first of the pair of abutment members 31 is coupled to the second end of the first wall 27 and a second of the pair of abutment members 31 is coupled to the second end of the second wall 28. Each of the pair of abutment members 31 is preferably an elongate member which has a longitudinal axis substantially parallel to the longitudinal axis of the or each cleaning arrangement 22,23. The pair of abutment members 31 define an access aperture of a predetermined dimensions. The access aperture provides access therethrough to the one or more cleaning arrangements 22,23.

The abutment members 31 are located a predetermined distance from the or each cleaning arrangement 22,23—generally, in a normal orientation, a predetermined height above the or each cleaning arrangement 22,23.

The cleaning apparatus 1 includes a mop 100. The mop 100 includes a mop material carrying member 101. The mop material carrying member 101 includes an engagement element 103 configured to be coupled to a mop handle 102. The mop 100 may further include the mop handle 102 coupled to the engagement element 103 of the mop material carrying member 101.

The mop material carrying member 101 further includes one or more mop material bracket arrangements 104 configured to secure mop material 110 to the mop material carrying member 101.

In an embodiment, the mop material carrying member 101 is configured to carry microfiber mop material 110 in the form of a flat sheet of material (see FIGS. 4-9).

In embodiments, the mop material carrying member 101 includes a central hub 105 from which the engagement element 103 extends. In embodiments, the engagement element 103 is coupled to the central hub 105 by a hinge 106. In embodiments, the engagement element 103 may be coupled to the central hub 105 by a pair of hinges 106—each hinge 106 of the pair of hinges 106 providing a respective axis of rotation and the axes being substantially perpendicular to each other. There may be a universal joint between the engagement element 103 and the central hub 105.

The mop material carrying member 101 may include a first and a second wing member 107*a*,107*b* coupled to the central hub 105. In embodiments, the first wing member 107*a* is coupled to the central hub 105 by a first hinge arrangement 108*a*. In embodiments, the second wing member 107*b* is coupled to the central hub 105 by a second hinge arrangement 108*b*. The first and second wing members 107*a*,107*b* are configured to move, about their respective hinges 108*a*,108*b*, between an operative position and an inoperative position. In the operative position, the first and second wing members 107*a*,107*b* are configured to support mop material 110 carried by the mop material carrying member 101 such that the mop material 110 can be moved over a surface to be cleaned by movement of the mop material carrying member 101 with respect to the surface—with the mop material 110 generally between the mop material carrying member 101 and the surface.

Figure 4:
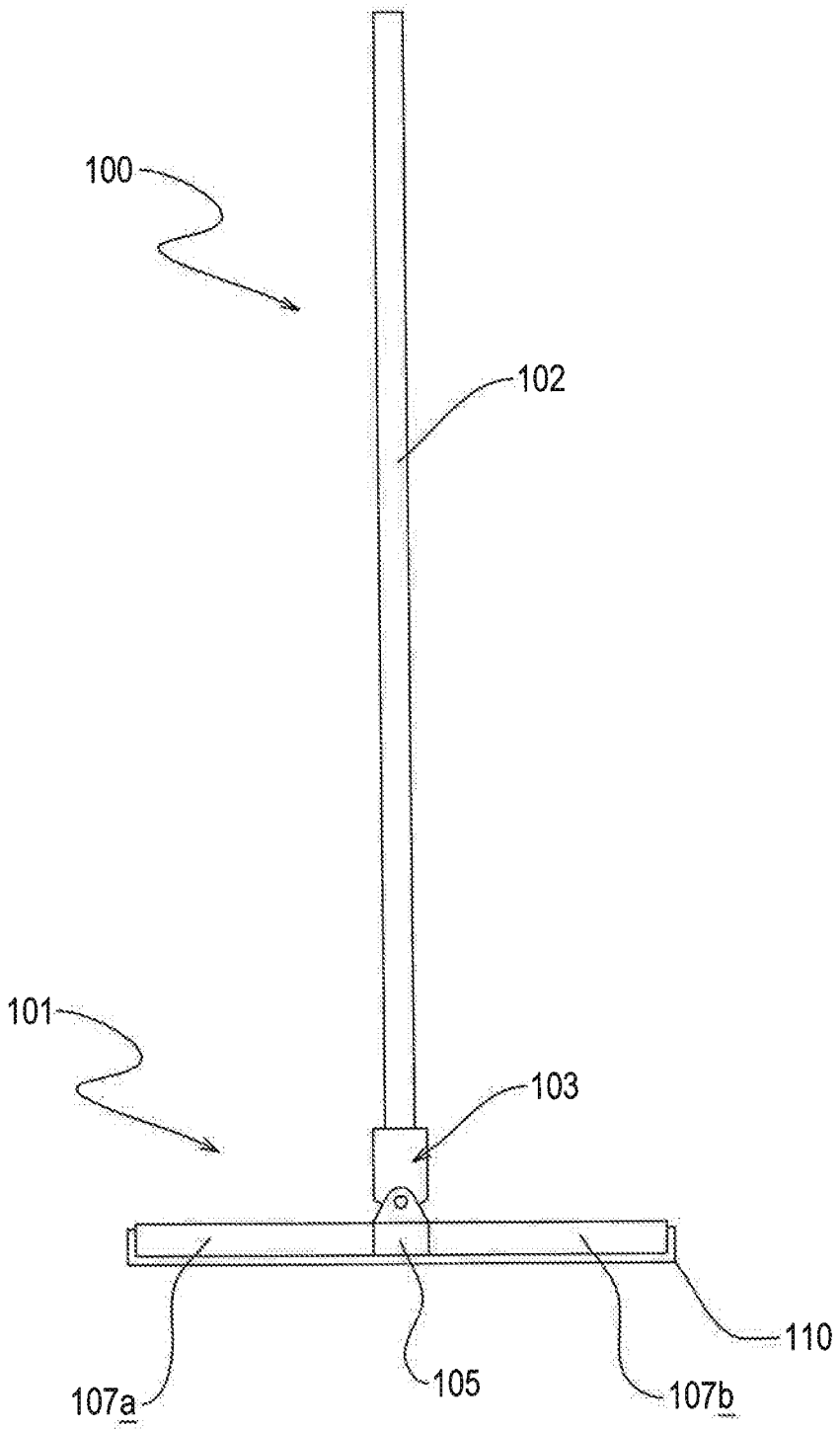
FIG. 4 shows a mop in accordance with embodiments.
Figure 5:
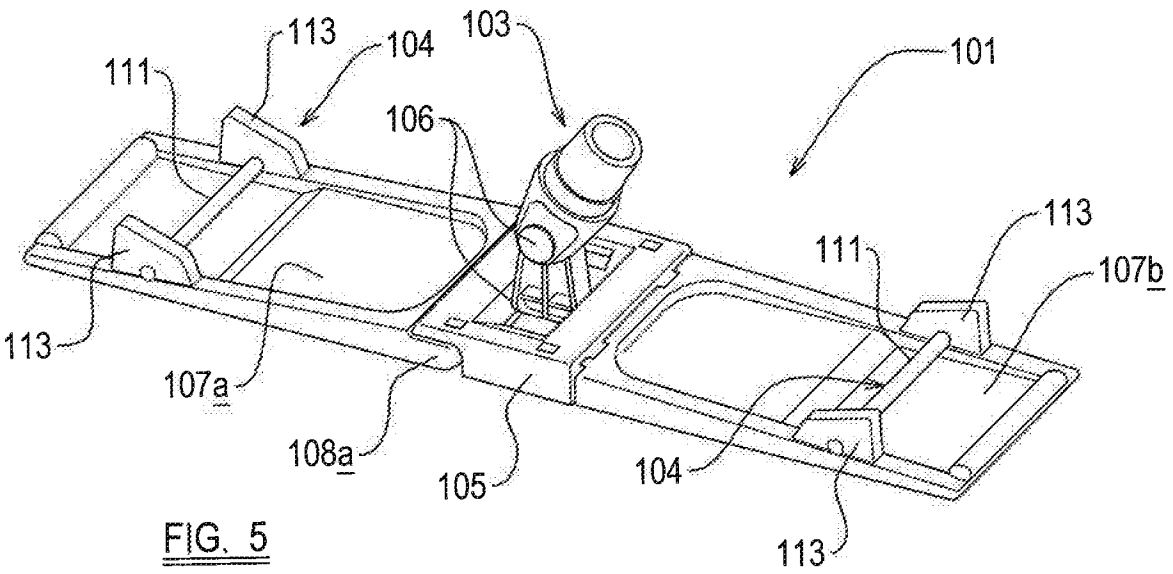
FIG. 5 shows aspects of a mop in accordance with embodiments.
Figure 6:
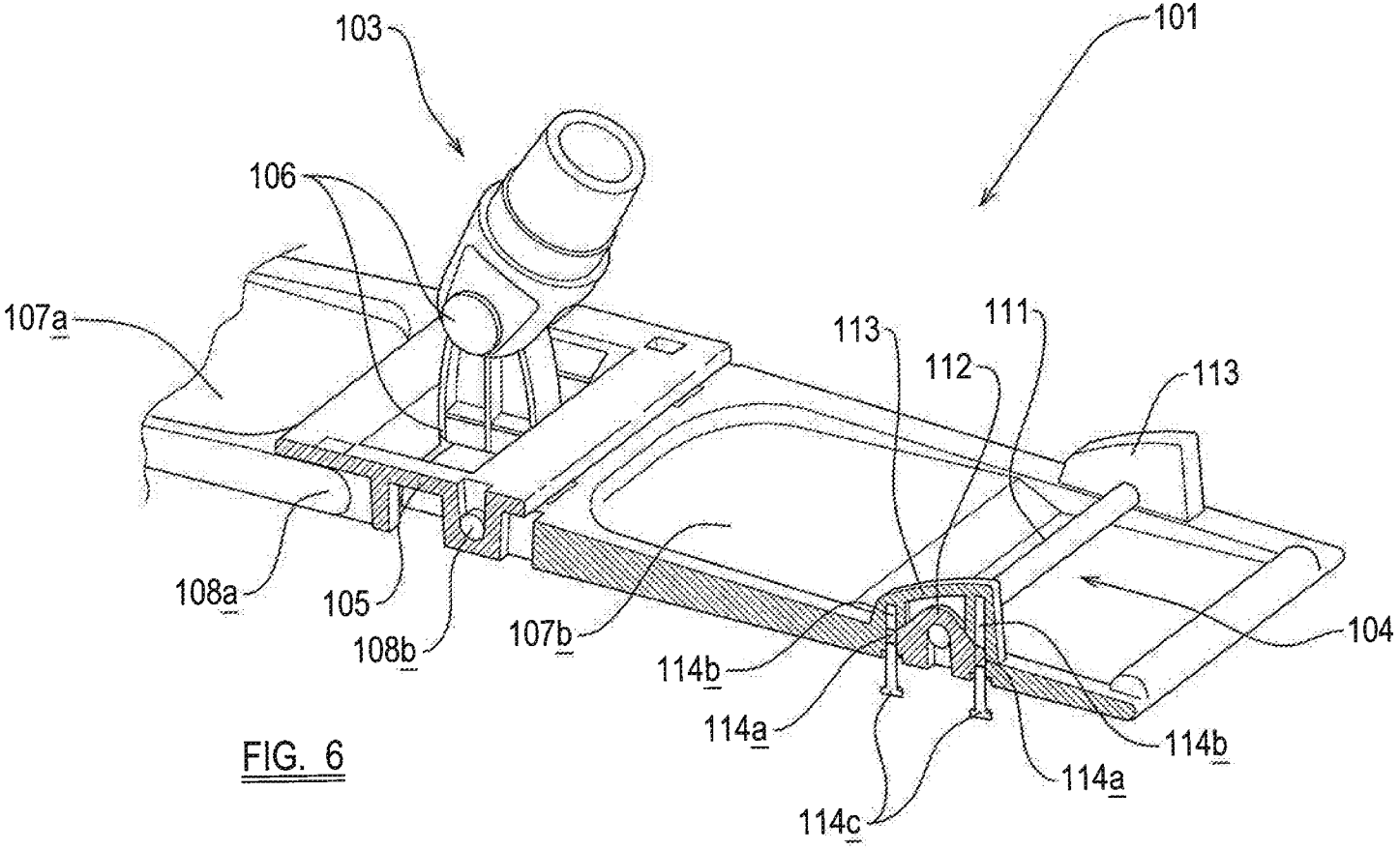
FIG. 6 shows (with a partial cross-sectional view) aspects of a mop in accordance with embodiments.
Figure 7:
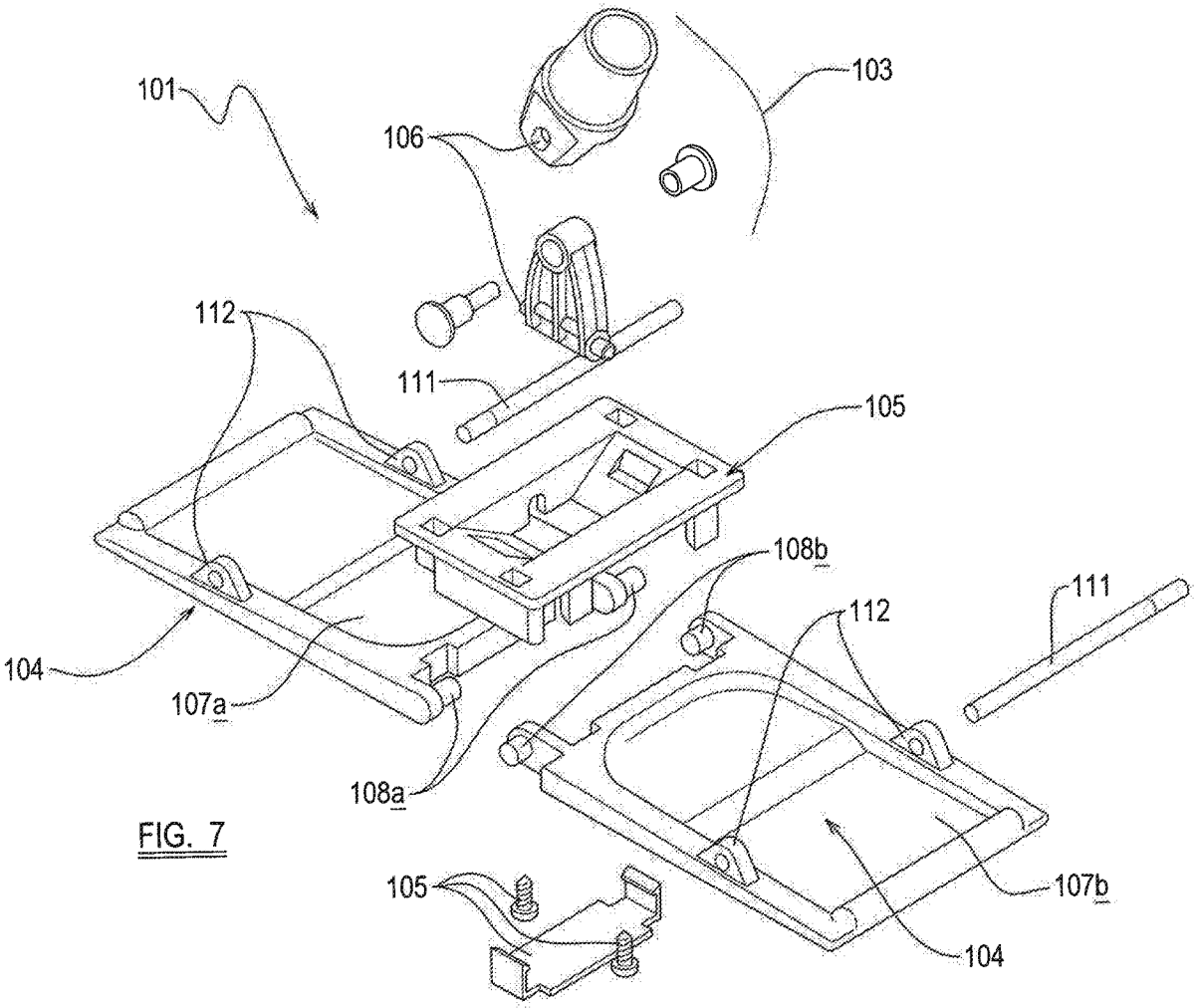
FIG. 7 shows aspects of a mop in accordance with embodiments.
Figure 9:
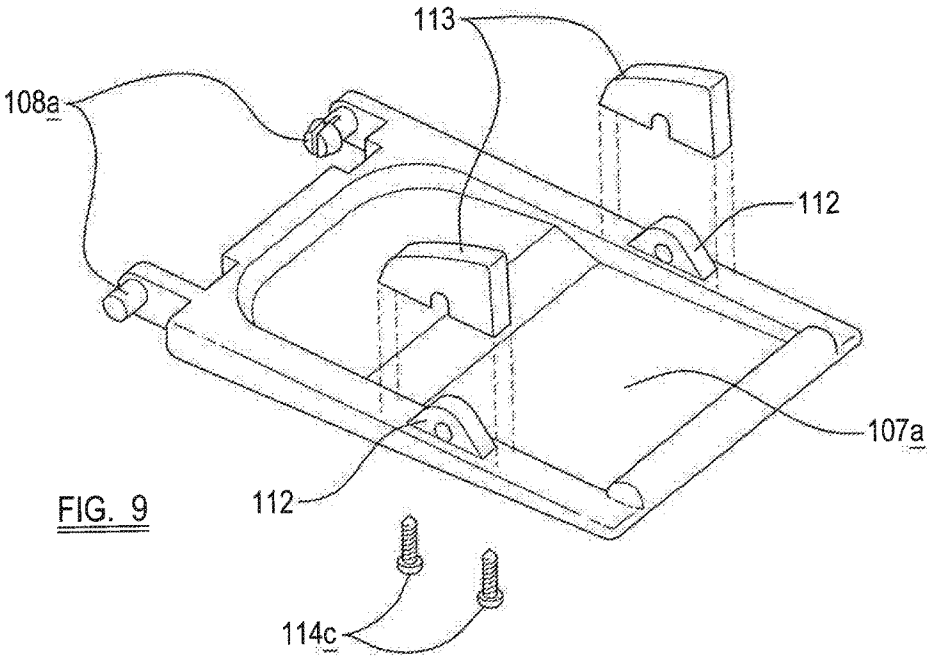
FIG. 9 shows aspects of a mop in accordance with embodiments.
Figure 8:
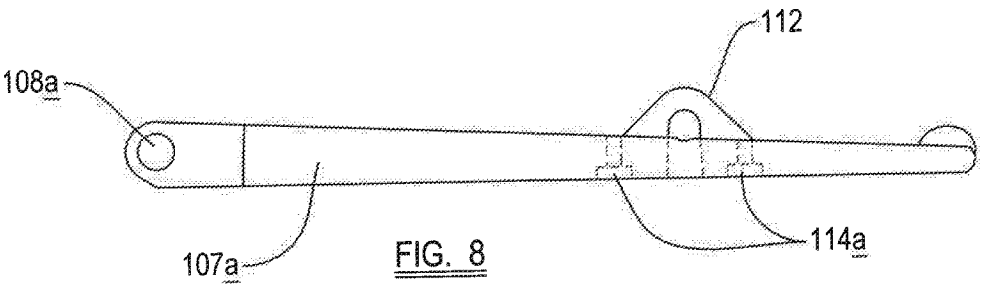
FIG. 8 shows aspects of a mop in accordance with embodiments.

In embodiments, the two wing members 107*a*,107*b*, in the operative position, form a substantially planar support surface for the mop material 110 (see FIG. 4). The central hub 105 may also form part of the planar support surface for the mop material. The two wing members 107*a*,107*b* may be held in the operative position by a holding arrangement, such as a clasp or ratchet.

In the inoperative position (see FIG. 2), the two wing members 107*a*,107*b* are not held by the holding arrangement (if provided). As such, the two wing members 107*a*, 107*b* are free to rotate about their respective hinge arrangement 108*a*,108*b*. The wing members 107*a*,107*b* in the inoperative position will tend to be positioned such that the distance between distal ends of the two wing members 107*a*,107*b* is reduced compared with the same distance when the wing members 107*a*,107*b* are in the operative position. In other words, the two wing members 107*a*,107*b* tend, in the inoperative position, to fold down such that their respective distal ends are adjacent each other.

The inoperative position of the wing members 107*a*,107*b* is typically utilised to fit new mop material 110 to the mop material carrying member 101—such that the mop material 110 can be fitted to the mop material carrying member 101 and then the wing members 107*a*,107*b* moved to the operative position such that the mop material 110 is supported by the substantially planar support surface.

The inoperative position of the wing members 107*a*,107*b* allows the mop material 110 carried by the mop material carrying member 101 to hang freely from the wing members 107*a*,107*b*. This allows the mop material 110 to be, for example, wrung using the wringer mechanism 40 or cleaned using the one or more cleaning arrangements 22,23.

In embodiments, the central hub 105 includes top and bottom pieces which are secured together in order to hold the first and second hinge arrangements 108*a*, 108*b* with respect to the central hub 105.

In embodiments, there may be a mop material bracket arrangement 104 associated with each wing member 107*a*, 107*b*. Each mop material bracket arrangement 104 may include a bar 111 coupled to a respective one of the wing members 107*a*,107*b*.

In embodiments, each bar 111 is held in place by two or more protrusions 112 of the wing members 107*a*,107*b*—for example, with one protrusion 112 carrying each end of one of the bars 111. The protrusions 112, therefore, form horns of the wing members 107*a*,107*b* in the depicted embodiment. These horns extend from a surface of the wing members 107*a*,107*b* which generally opposes part of the substantially planar support surface across a depth of the wing members 107*a*,107*b*.

In embodiments, the wing members 107*a*,107*b* include respective mop abutment members 113. In embodiments, each wing member 107*a*,107*b* includes at least one mop abutment member 113. The mop abutment members 113 are configured to provide a predetermined depth to the mop material carrying member 101 when the wing members 107*a*,107*b* are in the inoperative position and the free ends of the wing members 107*a*,107*b* are adjacent each other, touching each other, or otherwise generally close to each other.

In embodiments, each mop abutment member 113 includes a shell. An interior cavity of each shell is configured to receive a respective one of the protrusions 112. The mop abutment member 113 is, in embodiments, securable to a protrusion 112 by an attachment arrangement which may include, for example, one or more screws 114*c*. The or each screw 114*c* may be a self-tapping screw. One or more apertures 114*a* may be provided through or adjacent one of the protrusions 112. One or corresponding apertures 114*b* may be provided in the mop abutment member 113 such that each aperture 114*a* associated with a protrusion 112 is substantially aligned with the corresponding aperture 114*b* in the mop abutment member 113, when the protrusion 112 is received by the interior cavity of the shell of the mop abutment member 113, such that a screw 114*c* may be received by the aligned apertures 114*a*,114*b* to connect the mop abutment member 113 to the wing member 107*a*,107*b*.

Each mop abutment member 113 may, in an embodiment, be integrally formed with its associated wing member 107*a*, 107*b*.

In embodiments, each mop abutment member 113 includes an abutment surface 115 which extends away from the wing member 107*a*,107*b* with which the mop abutment member 113 is associated.

The mop abutment member 113 has a maximum height above a surface of the associated wing member 107*a*,107*b*, that height being defined by the abutment surface 115 of the mop abutment member 113.

In embodiments, each wing member 107*a*,107*b* is provided with a plurality of mop abutment members 113. In such embodiments, each mop abutment member 113 associated with a wing member 107*a*,107*b* is aligned with each other.

The or each mop abutment member 113 is a predetermined distance from the distal end of its associated wing member 107*a*,107*b*.

In embodiments, the predetermined distance from the distal end of a wing member 107*a*, 107*b* to the or each mop abutment member 113 associated therewith is substantially equal to or less than the predetermined distance between the abutment members 31 and the or each cleaning arrangement 22,23.

Thus, in use, a user may place the wing members 107*a*, 107*b* of a mop material carrying member 101 in the inoperative position such that mop material 110 carried thereby will hang freely (or substantially freely) from the wing members 107*a*,107*b*.

The mop material 110 may then be lowered into the cleaning device 20 and through the access aperture for the one or more cleaning arrangements 22,23. The or each cleaning arrangement 22,23 will engage the mop material 110 to clean (e.g. brush) the mop material 110 and hence clean the mop material 110. The mop material 110 is lowered by the user through the access aperture until the mop abutment members 113 of the wing members 107*a*,107*b*, and the abutment members 31 of the cleaning device 20 engage, or otherwise abut, each other. This engagement substantially prevents further movement of the wing members 107*a*,107*b* into the cleaning device 20 through the access aperture. The relative positioning of the mop abutment members 113 and the abutment members 31 of the cleaning device 20 mean that the or each cleaning arrangement 22,23 act on substantially all of an main portion of the mop material 110—the main portion being the portion thereof which is used to clean a surface when in use.

The mop abutment members 113 and the abutment members 31 of the cleaning device 20 seek to prevent or hinder the movement of the wing members 107*a*,107*b* to a position whereby they are engaged by the or each cleaning arrangement 22,23.

The mop abutment members 113 and the abutment members 31 of the cleaning device 20 are, as will be understood, configured for abutment to ensure or seek to ensure that movement of the mop material carrying member 101 with respect to the or each cleaning arrangement 22,23 is limited or restricted.

It will be understood that embodiments of the present invention can be used with mops having mop material other than microfiber mop material. It will be understood that embodiments can be used with mops having strands of mop material which generally hang free from one end thereof during use.

It will be appreciated that, in embodiments, the pair of abutment members 31 of the cleaning device 20 may include a flat (or substantially flat) surface and a protrusion, wherein the flat surface guides movement of the mop material carrying member such that the mop abutment member 113 abuts the protrusion. Accordingly, the mop abutment member 113 may abut one (or more) of the abutment members 31 of the cleaning device 20.

Embodiments of the invention include a method of using the cleaning apparatus 1 to clean mop material by lowering mop material through the access aperture between the abutment members 31 of the cleaning device 20 (until the mop abutment member 113 abuts one of the abutment members 31) and then raising the mop material out of the access aperture.

Embodiments also include a method of retrofitting a mop abutment member 113 to a mop 101.

The or each cleaning arrangement 22,23 may include a roller. The roller is rotatable about an axis—preferably a central longitudinal axis thereof. The roller may include a plurality of bristles or other brushing members—such as rubber (or synthetic rubber) tongues or bands. In embodiments, the roller includes a helical rubber (or synthetic rubber) strip which extends radially from the roller. It will be understood that different types of cleaning arrangement 22,23 may be used in combination.

The or each cleaning arrangement 22,23 is configured to clean, at least partially, mop material presented to the cleaning arrangement 22,23. The or each cleaning arrangement 22,23 may, therefore, brush and/or scrape and/or scour and/or scrub the mop material.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A cleaning apparatus including a mop and a cleaning device, wherein:

the mop includes:

a mop material carrying member for holding mop material; and a mop abutment member located on the mop material carrying member, the cleaning device is for cleaning the mop material which freely depends from the mop material carrying member of the mop, the cleaning device includes:

one or more cleaning arrangements for brushing, scraping, scouring or scrubbing mop material; and a pair of abutment members located with respect to the one or more cleaning arrangements and at least partially defining an access aperture through which access to the one or more cleaning arrangements is provided, wherein the pair of abutment members include elongate members, which have longitudinal axes that are substantially parallel to a longitudinal axis of the one or more cleaning arrangements, and the mop abutment member and the pair of abutment members of the cleaning device are configured for abutment in use to limit movement of the mop material carrying member through the access aperture towards the one or more cleaning arrangements.

2. A cleaning apparatus according to claim 1, wherein the one or more cleaning arrangements includes one or more brushes.

3. A cleaning apparatus according to claim 2, wherein each of the one or more brushes includes a rotatable roller that supports a plurality of bristles or other brushing members.

4. A cleaning apparatus according to claim 1, wherein the one or more cleaning arrangements are drivable by a motive device.

5. A cleaning apparatus according to claim 1, wherein the one or more cleaning arrangements include one or more rotatable rollers.

6. A cleaning apparatus according to claim 5, wherein each rotatable roller is configured to be rotated so as to draw the freely depending mop material through the access aperture.

7. A cleaning apparatus according to claim 1, wherein the cleaning device further includes a wringer mechanism.

8. A cleaning apparatus according to claim 7, wherein the wringer mechanism is configured for operation independently of the one or more cleaning arrangements.

9. A cleaning apparatus according to claim 1, wherein the mop material carrying member includes a central hub and at least one wing member.

10. A cleaning apparatus according to claim 1, wherein the mop material carrying member includes a bracket arrangement configured for removably holding mop material.

11. A cleaning apparatus according to claim 10, wherein the bracket arrangement includes a bar.

12. A cleaning apparatus according to claim 10, wherein the mop abutment member is secured to the bracket arrangement.

13. A cleaning apparatus according to claim 1, wherein the mop includes a plurality of mop abutment members located on the mop material carrying member.

14. A cleaning apparatus according to claim 1, wherein the mop further includes the mop material, which freely depends from the mop material carrying member.

15. A cleaning apparatus according to claim 14, wherein the mop abutment member and at least one of the pair of abutment members are configured for abutment in use to limit movement of the mop material carrying member with respect to the one or more cleaning arrangements such that substantially all of the mop material is contactable with at least one of the one or more cleaning arrangements during use.

16. A cleaning apparatus according to claim 1, wherein the mop abutment member and at least one of the pair of abutment members are configured for abutment in use to limit movement of the mop material carrying member with respect to the one or more cleaning arrangements such that the mop material carrying member is substantially prevented from contacting the one or more cleaning arrangements during use.

17. A method of using a cleaning apparatus including a mop and a cleaning device, wherein:

the mop includes:

a mop material carrying member for holding mop material; and a mop abutment member located on the mop material carrying member, the cleaning device is for cleaning mop material which freely depends from the mop material carrying member of the mop, the cleaning device includes:

one or more cleaning arrangements for brushing, scraping, scouring or scrubbing mop material; and a pair of abutment members located with respect to the one or more cleaning arrangements and at least partially defining an access aperture through which access to the one or more cleaning arrangements is provided, wherein the pair of abutment members include elongate members, which have longitudinal axes that are substantially parallel to a longitudinal axis of the one or more cleaning arrangements, and the mop abutment member and the pair of abutment members of the cleaning device are configured for abutment in use to limit movement of the mop material carrying member through the access aperture towards the one or more cleaning arrangements, the method including:

moving the mop material carrying member towards the one or more cleaning arrangements of the cleaning device until the mop abutment member abuts the abutment member of the cleaning device.

18. A method according to claim 17, further including:

subsequently moving the mop material carrying member away from each cleaning arrangement of the cleaning device.

19. A cleaning apparatus according to claim 17, wherein the one or more cleaning arrangements includes one or more brushes.

20. A cleaning apparatus according to claim 19, wherein each of the one or more brushes includes a rotatable roller that supports a plurality of bristles or other brushing members.

* * * * *